United States Patent [19]

James et al.

[11] 4,117,646

[45] Oct. 3, 1978

[54] METHOD OF APPLYING A LID TO A CASE

[75] Inventors: Robert C. James; David A. Wilson, both of Sheboygan; Dennis P. Horsman, Sheboygan County, all of Wis.

[73] Assignee: Hayssen Manufacturing Company, Sheboygan, Wis.

[21] Appl. No.: 703,973

[22] Filed: Jul. 9, 1976

[51] Int. Cl.[2] ..... B65B 7/20; B65B 7/28

[52] U.S. Cl. ..... 53/488

[58] Field of Search ..... 53/38, 41, 42, 287, 53/290, 306, 344, 375, 387, 329

[56] References Cited

U.S. PATENT DOCUMENTS

| | | | |
|---|---|---|---|
| 3,452,507 | 7/1969 | Lee | 53/42 |
| 3,501,895 | 3/1970 | Geyer | 53/287 |
| 3,516,227 | 6/1970 | Baker et al. | 53/387 X |
| 3,634,995 | 1/1972 | Curtis | 53/38 |
| 3,913,300 | 10/1975 | Benzing | 53/287 |
| 3,951,049 | 4/1976 | Brackmann et al. | 53/38 X |
| 3,955,342 | 5/1976 | Johnson et al. | 53/387 |
| 3,979,883 | 9/1976 | Patsaros | 53/306 |

*Primary Examiner*—Horace M. Culver

*Attorney, Agent, or Firm*—Koenig, Senniger, Powers and Leavitt

[57] ABSTRACT

Method of an apparatus for applying a telescoping lid to an open top, filled box or case in which the lid is formed from a flat blank around the case, in which the lid is pressed down on the contents of the case, in which the major flaps of the lid are pressed in against the sides of the case between a ram and a previously lidded case, and in which the minor flaps are pressed in against the ends of the case so as to square up the lid on the case prior to the flaps being secured together. The apparatus includes tucking units for folding the outer end portions of the major flaps of the lid in on the case along vertical fold lines with the tucking units being driven by upward movement of the case being lidded.

3 Claims, 17 Drawing Figures

METHOD OF APPLYING A LID TO A CASE

BACKGROUND OF THE INVENTION

This invention relates to apparatus for and method of applying a lid to a filled box or case, and more particularly to apparatus for and method of lidding a case filled with a product, such as wrapped reams of paper, in which the lid is a so-called telescoping lid formed from a one-piece, preslotted blank with the lid being formed around the filled case.

In packaging wrapped reams of paper or the like, it is important that the reams be tightly packaged in the case with the reams uniformly supported on the bottom of the case and with the lid bearing directly on the topmost reams so that when several cases are stacked one on the other the weight of the cases is carried by the reams rather than by the sides of the case which could cause the case to partially collapse with possible consequent damage (i.e., bending) of the reams.

Generally, two types of boxes or cases are used to package wrapped reams, the first being a regular slotted container (RSC) having upper flaps which are folded down to close the case. The second type of case is an open top case which may be formed from either a half slotted container (HSC) similar to an RSC without the top flaps or from a so-called tray-type case formed from a preslotted one-piece flat blank. In the co-assigned U.S. Pat. No. 3,953,956, apparatus is disclosed which forms the fold lines for the top flaps at the same level as the height of the reams (even though the height of the reams may vary from case to case) and which folds down the top flaps thereby to insure that the reams support the weight of the other cases stacked thereon. Open top cases have been heretofore known to be well suited for packaging wrapped reams of paper because the height of the case can be selected so as to insure that with the desired number of reams placed in the case the reams extend above the upper edges of the case so that when a telescoping lid is fitted on the open top case the center panel of the lid will bear on the reams rather than on the upper edges of the case. Because the height of the reams in the case may vary from case to case, this height variance may be readily accommodated by the open case and the overfitting, telescoping lid.

It is known that by forming a telescoping lid from a flat blank around a case to be lidded a tighter package will result and dimensional variances of the case and of the product being packaged can be readily accommodated. Generally, these telescoping lids are formed from a preslotted and prescored flat blank of corrugated paperboard having a central panel and flaps at the sides and ends of the central panel which may be folded down on the sides and ends of the case. Either the side or end flaps of the lid (these flaps constituting major flaps) have outer end portions which are adapted to be folded perpendicular to their respective flaps in on the case and to be secured to the other or minor flaps, as by gluing, so as to form an overfitting lid. Typically, prior lidding apparatus involved fitting the case on an case, forming the lid around the elevator, compressing the lid in against the case immediately after forming the lid so as to bring the flaps into contact with previously applied adhesive, holding the lid under compression for a time sufficient to permit the adhesive to set, and then off-loading the case from the elevator. Also, the mechanisms of these prior lidding apparatus for folding down the flaps and for compressing the lid in on the case were relatively complicated.

Reference may be made to such U.S. Pat. Nos. 3,634,995 and 3,913,300 which discloses prior art lidding machines generally similar to the apparatus of the present invention.

SUMMARY OF THE INVENTION

Among the several objects and features of the present invention may be noted the provision of methods of and apparatus for forming a lid around a filled, open top case thereby to readily accommodate differences in dimensions in the case and in the product therein; the provision of such methods and apparatus which eliminate the necessity of complicated folding arms for folding the major and minor flaps of the lid down on the case and for folding the outer ends of the major flaps in on the case; the provision of such methods and apparatus in which the folding of the ends of the major flaps in on the case is accomplished by upward movement of the case to be lidded so that this folding is automatically timed by movement of the case being lidded and so that any dimension variations of the case or the product therein are automatically taken into account; the provision of a method of lidding an open top case in which the lid is formed around the case and the lid flaps are secured together while the lid is pressed in against the sides and ends of the case and down on the product within the case; the provision of such methods and apparatus in which the next case to be lidded goes through at least part of its lidding operation while the last lidded case undergoes compression for squaring up the lid on the case and for enabling the adhesive securing the flaps together to properly set; the provision of such apparatus and method which utilizes previously lidded cases in the compression (i.e., squaring up) of the lid on the case; the provision of such apparatus and method which enables relatively high production rates; and the provision of such apparatus which is of relatively simple and rugged constructions and which is reliable in operation.

Briefly, this invention relates to apparatus for applying a lid to a filled case, the lid being formed around the case from a flat blank and having a central top panel and pairs of side and end flaps at the sides and ends of the central top panel with one of the pairs of flaps constituting major flaps having end portions extending out beyond the central top panel and with the other pair of flaps constituting minor flaps. The apparatus comprises means for holding a flat blank in a generally horizontal initial position. An elevator is provided for supporting a filled case to be lidded, the elevator being movable along a generally vertical path from a lowered position in which the case is below the lid blank initial position with the top of the case below the central panel of the lid blank to a raised position in which the top of the case is above the level of the lid blank initial position, the central panel of the lid blank being engageable by the case and the lid blank being movable upwardly with the case as the elevator moves upwardly towards its raised position. Means is provided along the vertical path above the initial lid blank position for engagement with the major and minor flaps of the lid blank as the lid blank moves upwardly with the case with resultant folding down of the major and minor flaps on their respective sides or ends of the case, and for folding the outer end portions of the major flaps in on the case. Means adjacent the raised position of the elevator receives the case with a partially formed lid thereon and other means is provided which is movable from a retracted position clear of the case on the elevator to an advanced position for engagement with one of the major flaps of the partially formed lid thereon for moving the case off the elevator onto the receiving means and into major-flap-to-major-flap abutting relation with the previously lidded case on the receiving means whereby the major flaps of the partially formed lid are pressed against the case by the movable means and by engagement with the previously lidded case.

The method of this invention for applying a lid to an open top case, the lid being generally as above described, involves the steps of applying adhesive to selected areas of a lid blank for securement of the outer end portions of the major flaps to the minor flaps. The lid blank is then placed in an initial horizontal position. A filled case is lifted from a position below the initial blank position to engage the central panel of the blank and to move it upwardly along a vertical path to a raised position. The major and minor flaps of the lid blank are folded down on the case as the lid blank and the case are moved upwardly toward the raised position of the case. The outer end poritions of the major flaps are at least partially folded on a vertical axis in on the case. When the case with the partially formed lid thereon is in its raised position, it is moved laterally into major-flap-to-major-flap abutting engagement with a previously lidded case so that the major flaps of the partially formed lid are pressed in against its respective case. The outer end portions of the major flaps and the minor flaps of the centrally formed lid are compressed against one another and against the respective case while the major flaps are under compression thereby to square up the lid on the case and to effect the securement of the outer end portions of the minor flaps together while the lid is squared up.

Other objects and features of this invention will be in part apparent and in part pointed out hereinafter.

BRIEF DESCRIPTION OF THE DRAWINGS

Corresponding reference characters indicate corresponding parts throughout the several views of the drawings.

DESCRIPTION OF THE PREFERRED EMBODIMENTS

Figure 3:
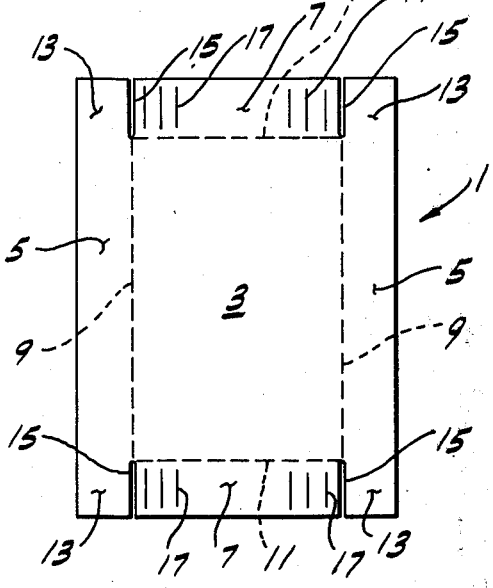
FIG. 3 is a plan view of a preslotted, precreased blank from which an overfitting telescopic lid is formed.
Figure 4:
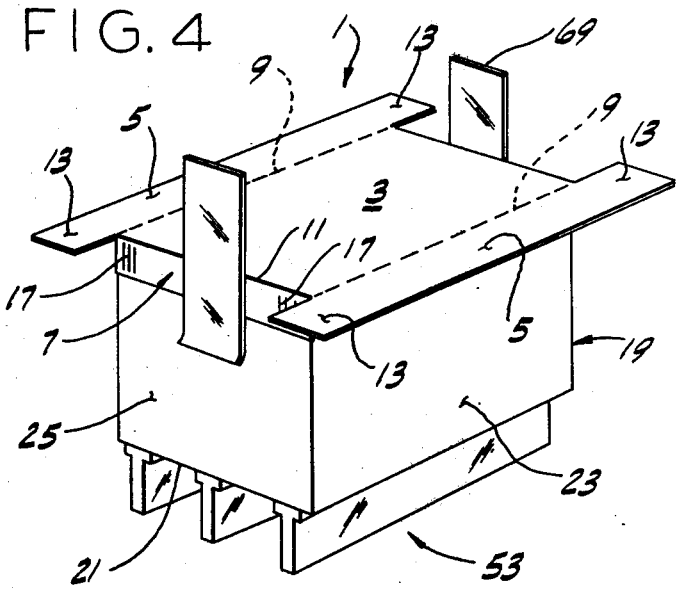
Figure 5:
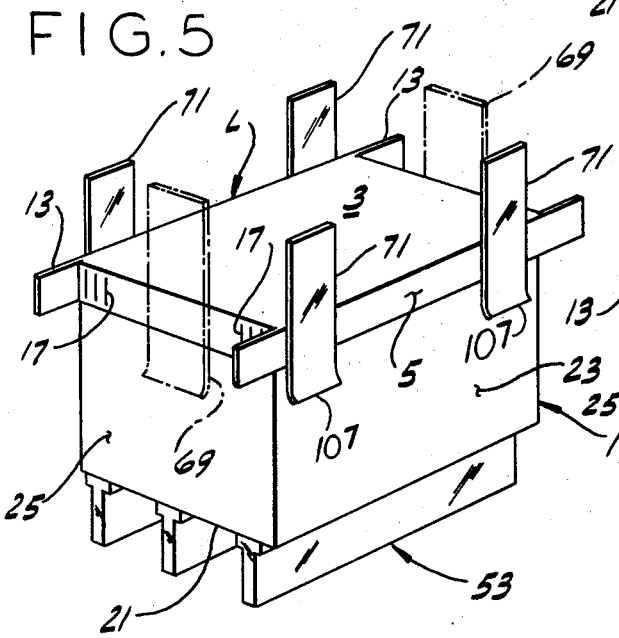

Referring now to the drawings, the method and apparatus of this invention form an overfitting or telescoping lid L from a flat, one-piece, preslotted and prescored blank 1 (see FIG. 3) of corrugated paperboard or the like having a central top panel 3 with side and end panels 5 and 7, respectively, at the sides and ends of the central panel and with precreased fold lines 9 and 11 at the sides and ends of the central panel. The side flaps have outer ends 13 which extend out beyond the ends of the central panel, each of these outer ends being separated from an adjacent end flap 7 by a slot 15. It will be understood that either side or end flaps 5 or 7 may be provided with outer ends 13, but whichever of the flaps carry these outer ends are hereinafter referred to as major flaps and the other flaps are referred to as minor flaps.

As shown in FIGS. 4–7, the side and end flaps 5 and 7 (i.e., the major and minor flaps) are adapted to be folded down relative to central panel 3 along fold lines 9 and 11 and the outer ends 13 of the major flaps are adapted to be folded in on the case on a generally vertical fold line or axis. The outer ends 13 of the major flaps and the end or minor flaps are adapted to be secured together (i.e., glued) so as to form an overfitting telescoping lid for an open top case. It will be understood that the outer ends may be disposed adjacent either the inner or outer faces of the folded down end or minor flaps. As is indicated at 17 in FIG. 3, the outer faces of end flaps 7 have stripes of adhesive (preferably a hot-melt adhesive) applied thereto so as to secure the outer ends 13 of the side flaps to the outer faces of the end flaps. It will be understood, however, that the glue stripes could be applied to the outer face of outer ends 13 so that with the outer ends folded in relative to the folded down side flaps the end flaps may be folded down on the outside of the folded in outer ends whereby the outer ends are secured to the inner faces of the end flaps.

Figure 1:
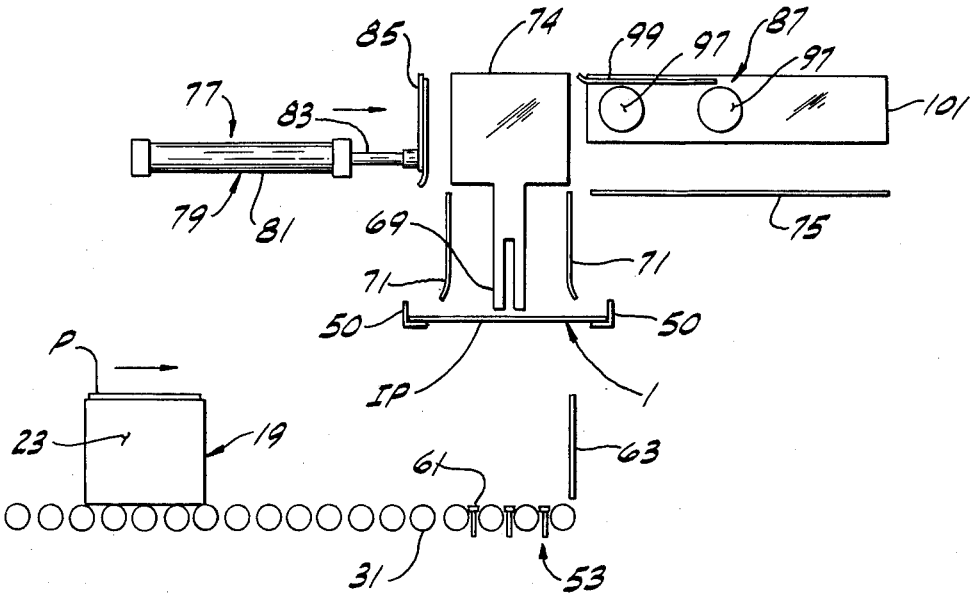
FIGS. 1, 2, and 4–11 diagrammatically illustrate both the apparatus for and method of the present invention for lidding a case.
Figure 2:
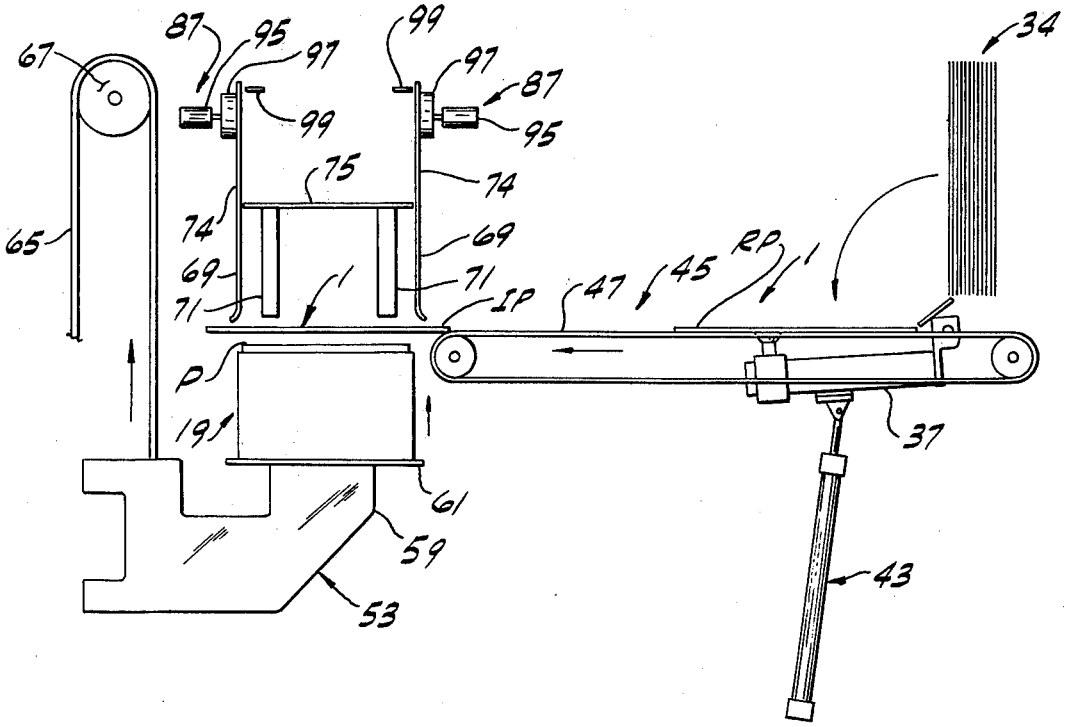

In accordance with the method and apparatus of this invention, lid blank 1 is adapted to be formed around an open top case or box 19 filled with a product P, such as wrapped reams of paper or the like. Case 19 has a bottom panel 21, side panels 23, and end panels 25 extending up from the sides and ends of the bottom panel. As is best shown in FIG. 1, the product P extends up above the upper edges of the side and end panels of the case whereby th central top panel 3 of lid blank 1 will bear directly on the product and will be held by the product above the upper edges of the side and end panels of the case. The height of the side and end panels of the case is so selected that with the desired amount of product in the case (e.g., with a predetermined number of reams of paper in the case), the product will always project up above the upper edges of the case even though the vertical height of the product in the case may vary from case to case. This insures that the top panel of the lid will not contact the upper edges of the case. The side and end flaps of the lid are of sufficient length as to extend down on the sides and ends of the case even when the product filling the case is relatively tall so as to effectively close the case and protect the product therein.

Figure 15:
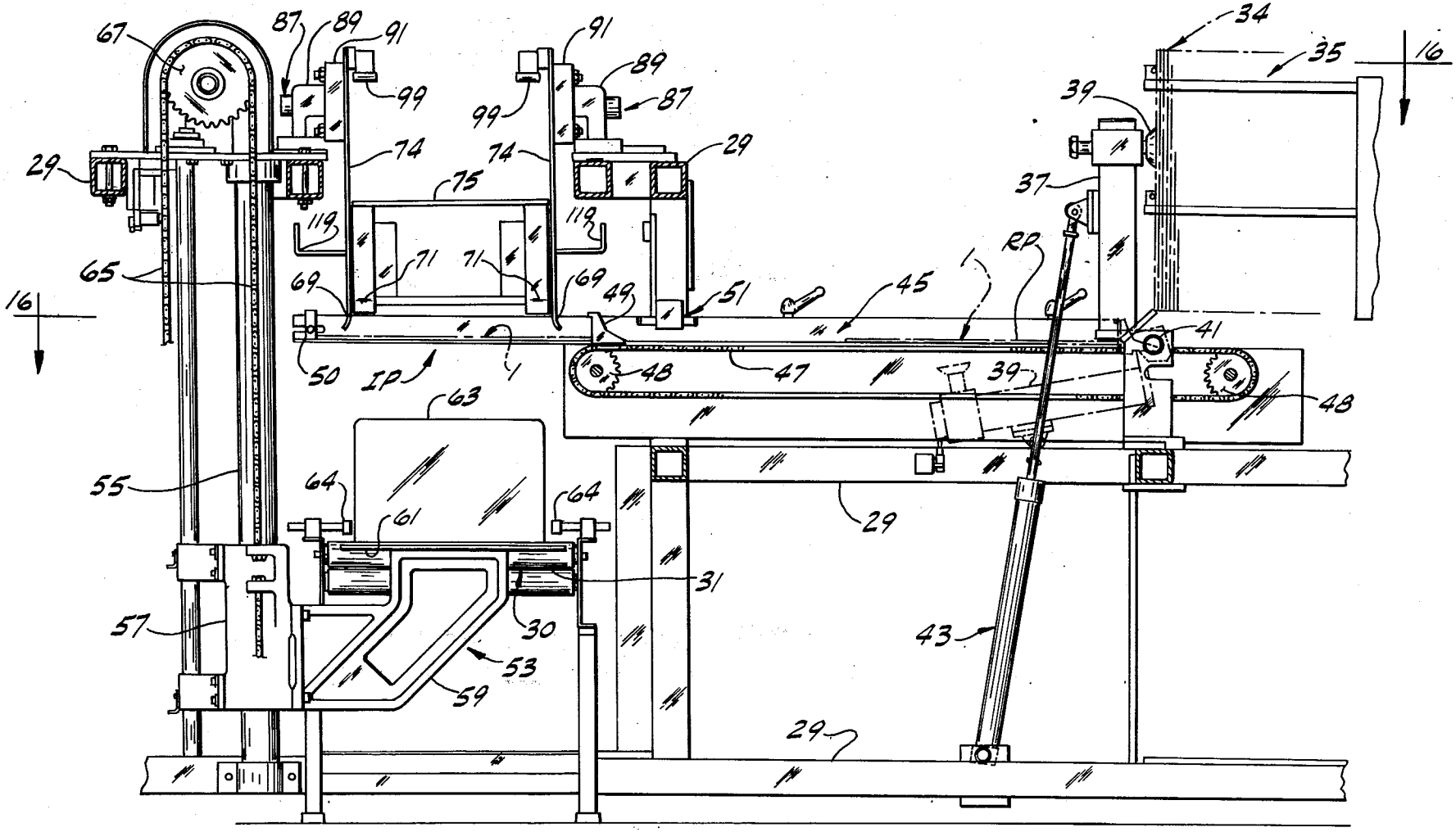
FIG. 15 is a vertical cross sectional view taken on line 15—15 of FIG. 14.

Referring now to FIG. 15, apparatus of this invention, indicated in its entirety at 27, for forming a lid L on an open top case 19 from a flat lid blank 1, is shown to comprise a rigid frame 29 having a power driven infeed conveyor 30 for delivery of filled cases to the apparatus to be lidded. This conveyor includes a plurality of rollers 31 driven by a belt 32 which in turn is driven by a gear motor 33 in a well-known manner.

Figure 16:
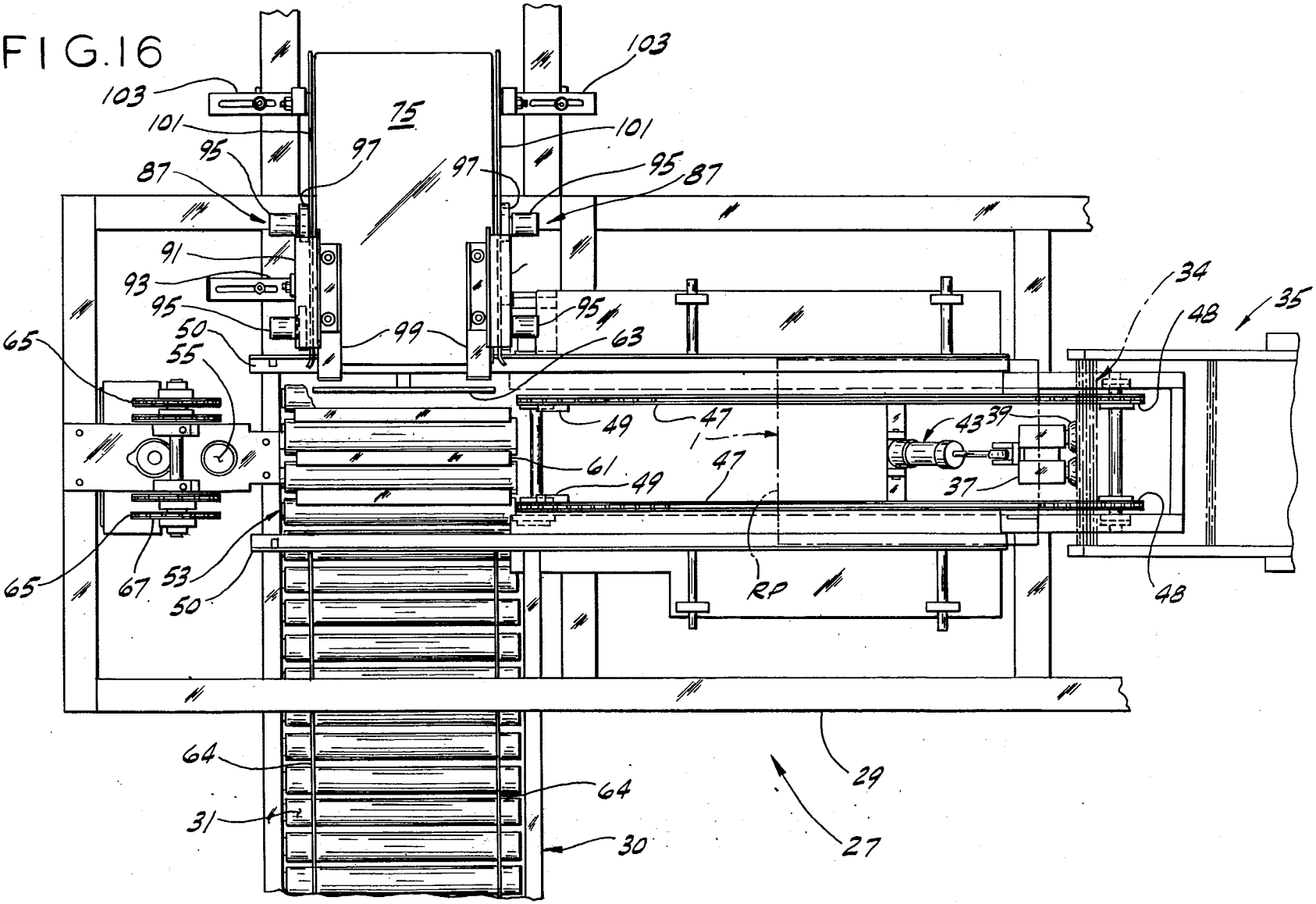
FIG. 16 is a horizontal cross section taken along line 16—16 of FIG. 15.

As generally indicated at 34 in FIG. 16, apparatus 27 includes a supply of lid blanks 1 held in a magazine 35 with the lid blanks being arranged in a stack resting on the lower edges of their end flaps, and a pivoted pick-up arm 37 having vacuum cups 39 on the outer end thereof for gripping the outwardly facing surface of the top panel 3 of the front lid blank in the magazine. Magazine 35 includes a suitable drive (not shown) for advancing the supply 34 of blanks 1 so that one of the blanks at the front of the stack is in proper position to be gripped by vacuum cups 39. Pick-up arm 37 is pivoted, as indicated at 41, on frame 29 for swinging from a generally vertical position (as shown in FIG. 16) in which vacuum cups 39 are disposed for gripping a blank in the magazine in a lowered position (as shown in phantom). An air cylinder unit 43 is pivotally interconnected between frame 29 and pick-up arm 39 to move the pick-up arm between its raised and lowered positions. It will be understood that other types of magazines may be provided along with other means for removing a blank from the magazine.

As indicated generally at 45, an infeed lid blank conveyor and support assembly is provided for receiving a lid blank 1 from magazine 35 and for conveying it horizontally to an initial blank position, as indicated at IP. This lid infeed conveyor is shown to have a pair of conveyor chains 47 trained around sprockets 48. Each chain has a flight bar 49 secured thereto for engagement with the rear edge of a lid blank 1 positioned on the lid blank infeed conveyor 45 by pick-up arm 39 in a ready position RP (as shown in phantom in FIG. 15). The infeed conveyor chains are intermittently driven through a cycle by a suitable drive (not shown) for advancing a lid blank from ready position RP on the infeed lid blank conveyor (i.e., the position of the lid blank deposited on the infeed conveyor by pivot arm 37) to its initial position IP. The infeed lid blank conveyor 45 further comprises a pair of spaced angles 50 which extend beyond the ends of conveyor chains 47 for engagement with the lower faces of side flaps 5 of a lid blank so as to support a flat lid blank in its above-mentioned initial position for engagement by case 19 in a manner as will appear. Angles 50 are releasably secured to frame 29 for adjustment toward and away from the centerline of lid conveyor 45 so as to accommodate lid blanks of various widths.

A pair of hot-melt adhesive dispenser guns 51 are provided above the lid blank infeed conveyor 45 and are adjustably mounted on frame 29 so as to dispense stripes 17 of hot-melt adhesive or the like onto preselected areas of the lid blank (e.g., on the outer faces of minor or side flaps 7 adjacent the outer ends thereof) for adhering the outer end portions 13 of major flaps 5 thereto when the latter are pressed in against the minor flaps and against its respective case. Adhesive dispensers 51 are so located as to apply the adhesive stripes to the blank as it is conveyed from its ready position RP in toward its initial position IP while the lid blank is being conveyed by conveyor chains 47.

Figure 8:
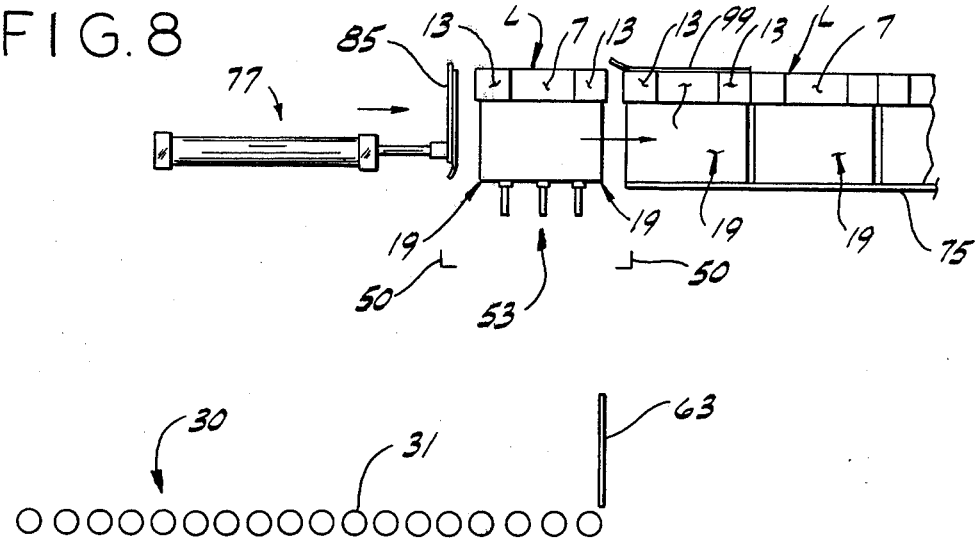

Apparatus 27 further comprises an elevator, generally indicated at 53, for supporting a filled case 19. The elevator is movable along a generally vertical path from a lowered position (as shown in FIG. 1) in which it is in position to receive a filled case from infeed conveyor 30 and in which the case on the elevator is positioned below center panel 3 of a lid blank 1 supported by its edges on angles 50 thereabove in its initial horizontal position IP to a raised position (as shown in FIG. 8) in which the case is above the level of lid blank 1 in its initial position. As the case and the elevator move toward their raised positions, the case and the elevator pass between angles 50 and the case (more particularly product P extending up above the case) engages central panel 3 of the lid blank and moves the lid blank upwardly from its initial position as the elevator continues to move upwardly.

Elevator 53 comprises a vertical slide shaft 55 rigidly mounted on frame 29 and spaced from case infeed conveyor 30. A slide bushing 57 surrounds the slide shaft and is movable vertically therealong. A plurality of arms 59 are cantilevered from the slide bushing. These cantilevered arms each have an upwardly facing horizontal surface 61 at the same level constituting a case support platform. These are so spaced from one another as to be disposed between rollers 31 of infeed conveyor 30 so that with the elevator in its lowered position surfaces 61 are positioned somewhat below the level of the conveyor rollers whereby a case to be lidded may be conveyed on the rollers to a position above the elevator arms. A case stop 63 is adjustably mounted on the frame and positioned relative to the elevator so as to be engaged by a case as it is fed forward by conveyor 30 thereby to stop the case in a desired position above elevator arms 59. Adjustable guide rails 64 are provided above conveyor rollers 31 for guiding the case toward the center of elevator 53 as it is conveyed theretoward. Slide bushing 57 along with elevator arms 59 is moved along shaft 55 between the above-stated raised and lowered positions of the elevator by means of endless chains 65 trained around upper and lower sprockets 67 carried by frame 29 with the sprockets being driven by a a hydraulic motor 68 (see FIG. 15).

Figure 6:
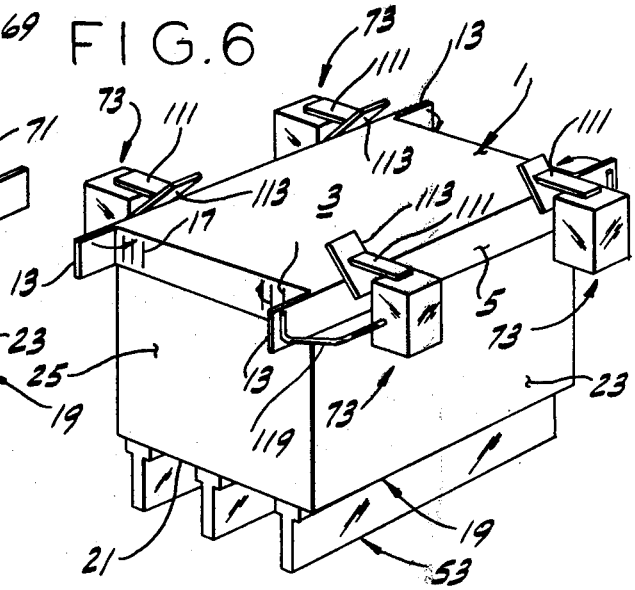

Folding shoes 69 are provided along the vertical path of elevator 53 above the initial blank position IP and are adjustably secured to frame 29 in position for engagement by minor flaps 7 of lid blank 1 to fold then down on fold lines 11 on the ends of case 19. Folding shoes 71 are also provided along the vertical path of the elevator for engagement by major flaps 5 for folding the major flaps down on the sides of the case as the elevator lifts the case and the lid blank above their initial position. As is indicated generally at 73, four so-called tucker units are adjustably carried by frame 29 engageable by the lid blank 1 as case 19 is lifted by the elevator for folding the outer ends 13 of major flaps 5 in on the case, and more specifically, as shown in FIG. 6, in on the previously folded down minor flaps 7. Shoes 69 and 71 are adjustably secured to frame 29 in a manner as will be hereinafter described for adjustment relative to one another and to frame 29 for accommodating cases 19 of different dimensions, and are stationary relative to the frame.

As best shown in FIG. 15, folding shoes 69 are preferably somewhat below the level of folding shoes 71 so that minor flaps 7 will be folded down on the ends of case 19 by shoes 69 before the major flaps 5 are folded down on the sides of the case by shoes 71. Shoes 69 extend down from side plates 74 secured to frame 29, these side plates being so positioned relative to the minor flaps of a partially formed lid on the case supported by the elevator when the latter is in its raised position so as to maintain outer ends 13 in their partially folded-in positions.

As generally indicated at 75, a support platform is mounted on frame 29 for receiving a case 19 with a partially formed lid L thereon from elevator 53 when the elevator is in its raised position. This platform also supports a series of previously lidded cases in major-flap-to-major-flap abutting relation with one another. The cases are slidable along the platform for purposes as will appear (see FIGS. 8–11).

Figure 9:
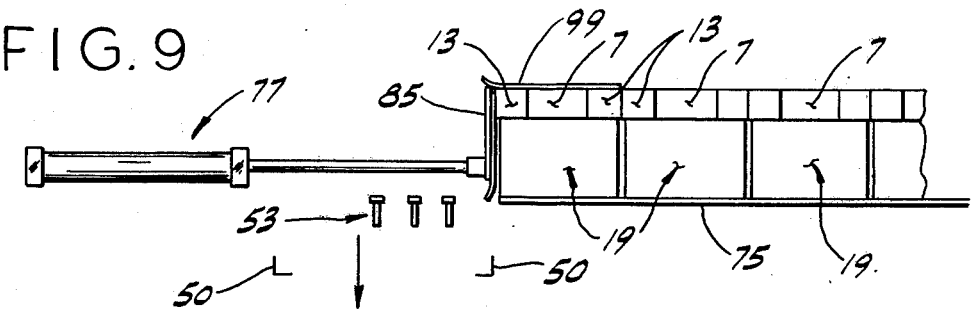
Figure 10:
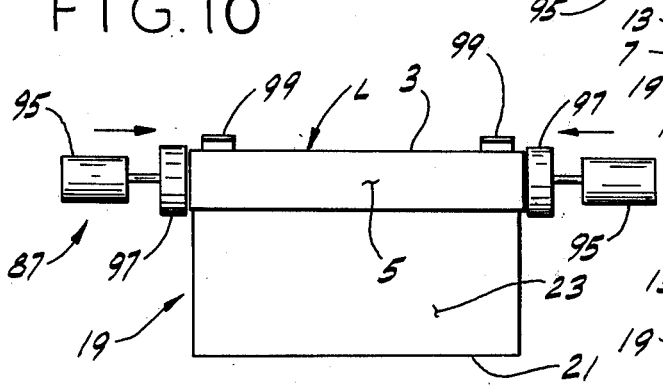
Figure 11:
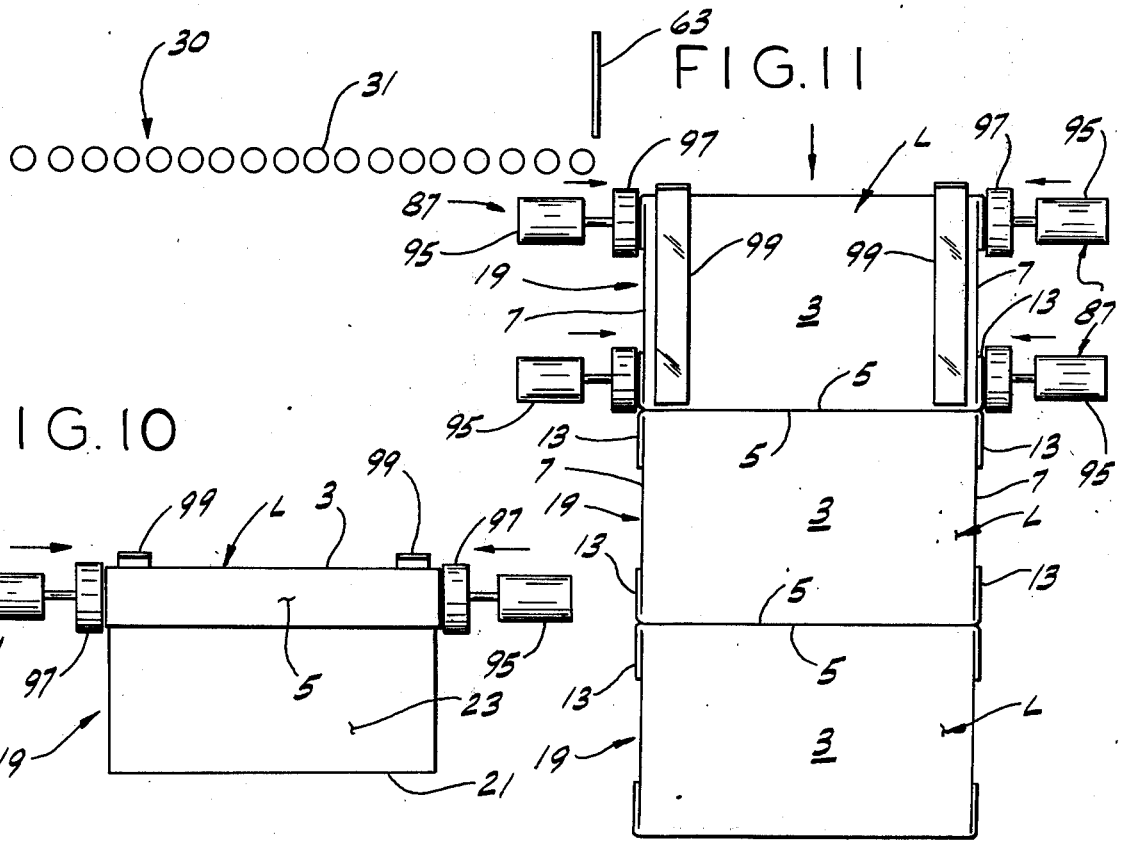

A ram 77 is mounted on frame 29 adjacent the raised position of elevator 53 and includes a fluid cylinder unit 79 having a cylinder body 81 and a piston rod 83 movable endwise therefrom, the piston rod carrying a platen 85 on its free end. Platen 85 and piston rod 83 are movable from a retracted position (as shown in FIGS. 1, 8 and 15) in which the platen is clear of a case 19 on the elevator when the latter is in its raised position to an advanced position (as shown in FIG. 9) for engagement with one side 23 of case 19 on the elevator and with one of the major flaps 5 of the lid being formed. Thus, the major flaps of the lid being formed are pressed in against the sides of its respective case by platen 85 and by the previously lidded case on platform 75 (see FIG. 9). It will be understood that once case 19 engages a previously lidded case on platform 75 further extension of ram 77 toward its fully extended or advanced position causes sliding of all the cases on the platform and that the frictional resistance of the sliding cases is sufficient to press major flaps 5 of the lid being formed in against its case.

As indicated generally at 87, pairs of selectively actuable air cylinder units are provided on opposite sides of receiving platform 74 of pressing minor flaps 7 and the outer ends 13 of major flaps 5 against one another and against their respective case 19 while the major flaps are undergoing compression between platen 85 and a previously lidded case on the platform thereby to square up lid L on the case and to effect securement of the minor flaps and the outer ends of the major flaps together while the lid is squared up on the case and held tightly thereagainst. This results in a tight fitting lid on the case and automatically accommodates any dimensional variances of the case or the product P therein. As previously mentioned, tucker units 73 only partially fold the outer ends 13 of major flaps 5 in on the case so that the outer ends do not contact adhesive stripes 17 on the outer faces of minor flaps 7. For example, flap tucker units may only fold the outer ends of the major flaps in on an angle of approximately 80° relative to the major flaps (see FIGS. 7 and 13). Thus, upon actuation of air cylinder units 87, the outer ends 13 are pressed in against the minor flaps and into contact with the adhesive stripes 17. Air cylinder units 87 are preferably actuated for a time sufficient to permit the adhesive to set thereby to secure the outer ends 13 and minor flaps 7 together. For example, if hot-melt adhesive is used as the adhesive, it may be necessary to only hold or press the outer ends and the minor flaps together for a few seconds to permit the adhesive to fully set.

In accordance with this invention, with ram 77 in its advanced position (as shown in FIG. 9) and with case 19 moved laterally from elevator 53 onto platform 75, the elevator may be lowered to its lowered position for receiving the next case to be lidded before ram 77 is retracted. This enables the compression of lid L to be carried out while the elevator is being lowered, the next case to be lidded is being delivered onto the elevator, the next lid blank is being conveyed forward to its initial position IP, and while the elevator begins to lift the next case to be lidded upwardly for engagement with its respective lid blank. Thus, the operating or cycling time of apparatus 27 of this invention is speeded up. For example, apparatus of this invention has been operated under production conditions to lid ten or more boxes per minute.

Side plates 74 and flap folding shoes 69 extending downwardly therefrom are adjustably secured to the frame 29 by brackets 89 (see FIG. 15) which may be locked in position on frame 29. On opposite sides of platform 75 rigid subframes 91 are adjustably secured to the frame by means of brackets 93. These subframes each carry a pair of air cylinder units 87, each of which comprises a cylinder body 95 secured to the subframe and a piston rod (not shown) having a compressible pad 97 on the outer end thereof engageable with the partially folded in outer ends 13 of major flaps 5 and with minor flaps 7 when the air cylinder units are extended. The piston rod of each of these air cylinder units is retracted by means of a spring (not shown) within cylinder body 95 and is normally retracted except when pressurized. With these air cylinder units in their retracted positions, a case 19 with a partially formed lid L thereon may be readily pushed from elevator 53 by ram 77 and onto platform 75 without interference by the compression pads 97 of the air cylinder units. Subframes 91 each carry a respective compression shoe 99 engageable with the central top panel 3 of lid blank 1 for pushing the lid blank down into engagement with the product P within case 19 which extends up above the upper edges of the sides and ends of the case for holding the lid in engagement with the product in the case while the lid is secured together on the case. Compression shoes 99 are adjustable relative to their respective subframes 91 and the subframes are adjustable relative to frame 29 so as to accommodate cases of various heights and widths.

Further along platform 75 a pair of side plates 101, one on each side of the platform, is adjustably secured to frame 29 by brackets 103. These side plates are spaced from one another a distance to accommodate a lidded case as it is ejected from between the pairs of air cylinder units 87 as another case is off-loaded from elevator 53 onto platform 75. These side plates maintain compression on the outer ends 13 of major flaps 5 and on minor flaps 7 of the lid L last compressed and secured by air cylinder units 87.

It will be understood that lidded cases 19 may be fed onto another conveyor (not shown) at the level of platform 75 or that the lidded case can be lowered to an outfeed conveyor (not shown) generally at the level of infeed conveyor 30 by means of another elevator (also not shown) generally similar to elevator 53.

Figure 12:
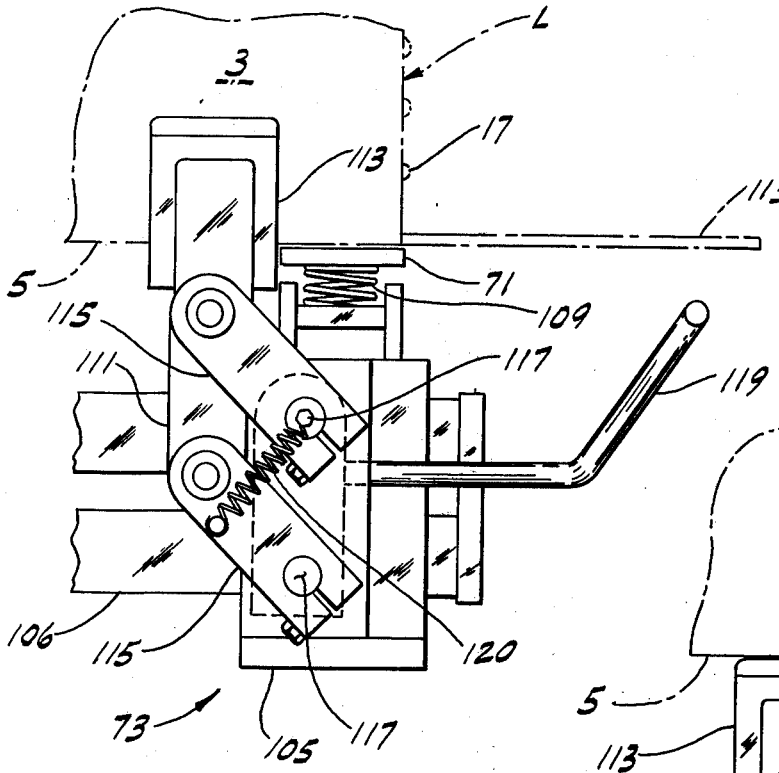
FIG. 12 is an enlarged plan view of a tucking unit of this invention for folding the outer end of a major flap of a lid blank (shown in phantom) in on the case, the tucking unit being shown in its retracted position.
Figure 13:
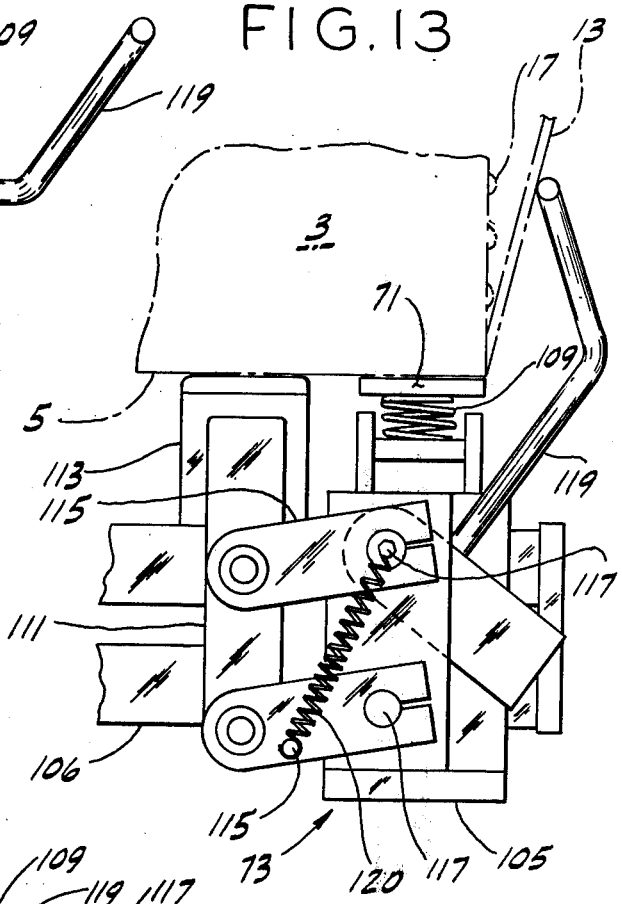
FIG. 13 is a view similar to FIG. 12 showing the tucking unit in its inner folding position.

As best shown in FIGS. 12 and 13, each outer end flap tucking unit 73 comprises a base 105 releasably secured to a cross beam 106 which in turn is rigidly connected to frame 29. The cross beam is movable toward and away from the vertical path of elevator 53 and base 105 is movable along the cross beam whereby each tucker unit may be adjustably positioned so as to accommodate cases 19 of various dimensions.

Each base 105 carries a generally vertically disposed major flap folding shoe 71 having an outwardly turned lower end 107. These shoes are spring mounted on their bases by means of compression springs 109 which bias the shoe inwardly toward a case 19 supported on elevator 53 and which permit the shoes to move outwardly against the bias of the springs. Preferably bases 105 are so positioned relative to a case on the elevator that as the lid blank moves upwardly with the elevator and the case, the major flaps 5 of the lid blank will engage the outwardly turned lower ends 107 of shoes 71 thereby to fold down major flaps 5 on fold lines 9. Upon further upward movement of elevator 53, the case will push the shoes outwardly against the bias of springs 109 with the springs pushing the minor flaps in against the sides of the case.

Tucking units 73 further each comprise a horizontally reciprocal slider 111 having a downwardly facing cam 113 engageable by lid L adjacent fold lines 9 thereon after major flaps 5 have been folded down on the sides of the case so that upon further upward movement of the case toward its raised position the slider member moves outwardly away from the case. A pair of parallelogram links 115 are pivotally connected to the slider member and are fixedly connected to shafts 117 journalled in base 105 so that in and out movement of the slider relative to the case causes shafts 117 to rotate about their axes. A folding arm 119 is secured to one of the shafts 117 and is rotatable therewith about a vertical axis (i.e., the axis of shaft 117) between the retracted position (as shown in FIG. 12) in which the folding arm is clear of an adjacent outer end 13 of an adjacent major flap 5 when slider 111 is in its innermost position and an inner folding position (as shown in phantom in FIG. 13) adjacent minor flap 7 of lid L for at least partially folding its adjacent outer end 13 in on the case. Slider 111 and folding arm 119 are biased toward their retracted positions by means of a spring 120. It will be noted that the folding arm is so structured that it engages its respective outer end 13 as far as possible from the end of case 19 so that upon movement of the folding arm in towards its inner folding position, the folding arm will exert as great a folding or bending moment as possible on the outer end to be folded so as to "break" the major flap on the vertical edge or corner of case 19. In this manner, folding arms 119 fold the outer ends 13 in on the case on a vertical fold line, but the outer end portions of the major flaps need not be precreased or prescored. Also, any dimensional variations of the case are automatically taken into account by tucker units 73. It will also be noted that merely by adjusting the position of the tucking units 73 on crossbeams 106 and shoes 69 on frame 29, cases of different dimensions can be readily accommodated without requiring movement of any complicated linkage or actuating arrangements for folding down the major and minor flaps 5 and 7 and for folding the outer ends 13 in on the case.

Figure 7:
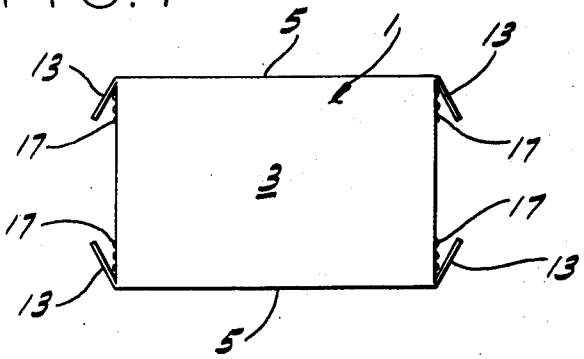
Figure 17:
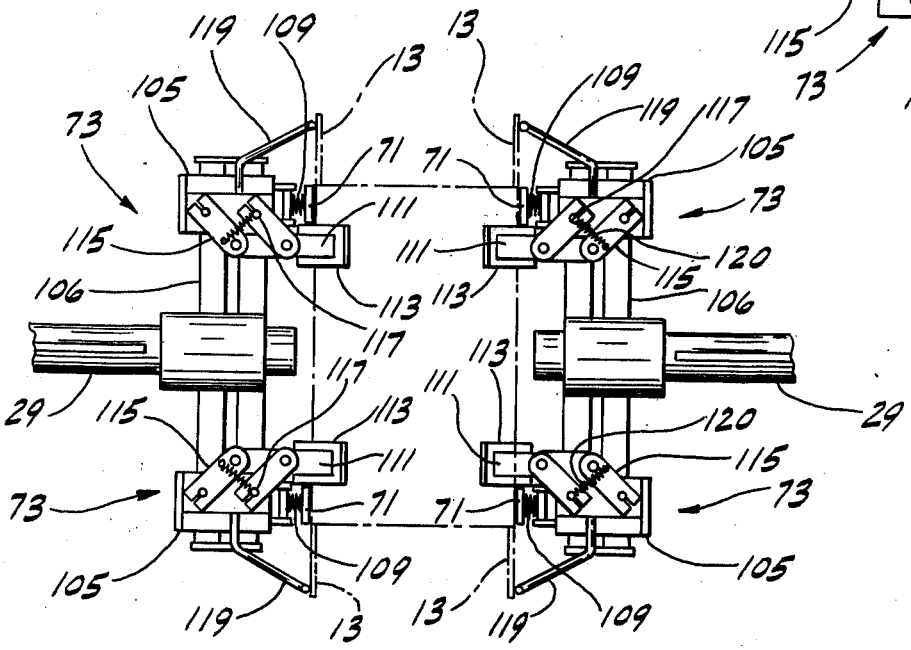
FIG. 17 is a partial horizontal cross section taken along line 17—17 of FIG. 14
Figure 14:
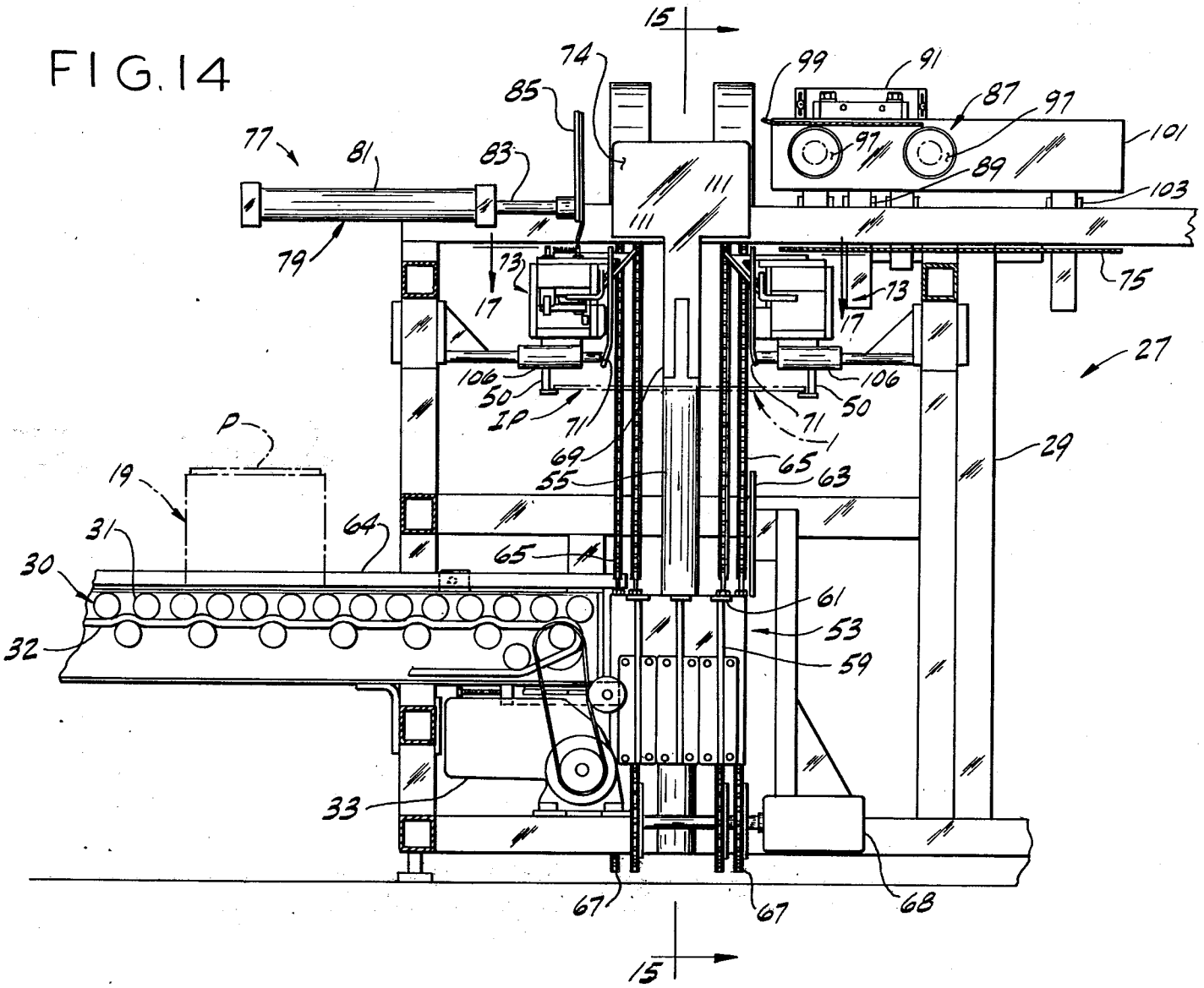
FIG. 14 is a vertical longitudinal cross sectional view of apparatus of this invention.

As previously mentioned, folding arms 119 preferably only partially fold outer ends 13 in on case 19 so as to prevent the inner face of the outer ends from becoming adhered to the minor flaps by adhesive stripes 17 previously applied to the minor flaps. As is shown in FIGS. 7 and 17, outer ends 13 are preferably folded in on an angle of about 80° relative to the major flaps. As shown in FIG. 15, minor flap folding shoes 69 are positioned somewhat below the level of major flap folding shoes 71 so that the minor flaps are folded down on the case prior to the major flaps being folded down. With the folding shoes so positioned, outer end tucker units 73 fold outer ends 13 of the major flaps in on the minor flaps. It will be understood, however, that by raising the minor flap folding shoes 69 above the level of the major flap folding shoes 71, the major flaps may be folded down on the case and the outer ends 13 of the major flaps may be folded in on the ends of the case prior to the minor flaps being folded down to overlie the outer ends and to thus form a so-called finished lid. In producing finished lids, it will be understood that adhesive stripes 17 are applied to the outer faces of outer ends 13 of the major flaps so as to adhere the inner faces of the minor flaps to the outer ends.

In accordance with the method of this invention of applying a lid L to an open top filled case 19, adhesive stripes 17 are applied to selected areas of a flat lid blank 1 for securement of outer ends 13 of major flaps 5 to minor flaps 7. The lid blank is then placed in an initial horizontal blank position IP and a filled case 19 is lifted from a position below the initial lid blank position to engage the central top panel 3 of the lid blank and to move it upwardly along a generally vertical path to a raised position. The major and minor flaps 5 and 7 of the lid blank are folded down on the sides and ends of the case as the lid blank and the case are moved upwardly to the abovementioned raised position. Outer ends 13 of major flaps 5 are at least partially folded in on the ends of case 19 along a substantially vertical fold line. The case with the partially formed lid L thereon is then moved laterally when the case is in its raised position into major-flap-to-major-flap abutting engagement with a previously lidded case (see FIG. 9) so that the major flaps of the partially formed lid L are pressed in on its respective case. Finally, the outer ends 13 of the major flaps of the partially formed lid are compressed in against one another and against its respective case 19 while the major flaps remain under compression thereby to square up the lid on its case and to effect the securement of the outer ends of the major flaps to the minor flaps as by pressing the minor flaps in on the case and by pressing the outer ends 13 against adhesive stripes 17 on the minor flaps thereby to adhere the outer ends to the minor flaps. The outer ends and the minor flaps are then held under compression for a time sufficient to permit the adhesive stripes to set up thereby to hold the outer ends and the minor flaps in securement with one another. Also, the method of this invention advantageously permits the next case to be lidded to be at least partially raised while the last lidded case is undergoing compression and thus effects a speed-up of the cycling time required to lid a case.

From the above description of the method of this invention for applying a tray-type lid to an open top case, the operation of apparatus 27 of this invention is believed to be readily apparent. It will be understood that apparatus 27 may include suitable limit switches and other controls for effecting the automatic operation of the several components of the apparatus in the proper sequence and in the desired timed relation relative to one another, and that the provision of such a control system would be apparent to one of ordinary skill in the packaging art. Thus a detailed description of this control system is not included in this disclosure.

In view of the above, it will be seen that the several objects of the invention are achieved and other advantageous results attained.

As various changes could be made in the above constructions and methods without departing from the scope of the invention, it is intended that all matter contained in the above description or shown in the accompanying drawings shall be interpreted as illustrative and not in a limiting sense.

What is claimed is:

1. A method of applying a lid to an open top filled case, said lid being formed from a flat one piece blank having a central panel and side and end flaps at the sides and ends of the central panel adapted to be folded down on fold lines on the sides and ends of the central panel, with one of the pairs of flaps constituting major flaps and having end portions extending out beyond said central panel and with the other pair of flaps constituting minor flaps, said method comprising the steps of:

applying adhesive to selected areas of said blank for securement of said outer end portions of said major flaps to said minor flaps;

placing a blank in an initial blank position;

lifting a filled case from a position below said initial blank position to engage said blank and to move it upwardly along a vertical path to a raised position;

folding down the major and minor flaps of the lid blank on the case as the lid blank and the case are moved upwardly toward said raised position;

effecting partial folding of the outer end portions of said major flaps on vertical fold axes in on said minor flaps by the upward movement of said case and said lid bank while the case and the lid are being lifted;

moving said case with said partially formed lid thereon laterally when the case is in its said raised position into major flap-to-major flap abutting engagement with a previously lidded case while pressing a trailing major flap of the partially formed lid in against its case so that the major flaps of said partially formed lid are pressed in against their respective case; and compressing said partially folded in outer end portions of said major flaps and said minor flaps of said partially formed lid against one another and against its respective case while both of said major flaps of said partially formed lid are under compression thereby to square up said lid on its case and to effect the securement of said outer end portions and said minor flaps together while the lid is squared up.

2. The method of claim 1 further comprising maintaining compression on both major and both minor flaps of said lid for a time sufficient to permit said adhesive to secure the outer end portions and the minor flaps together.

3. The method of claim 2 further comprising raising the next case to be lidded toward said raised position while the last lidded case is undergoing said compression.

* * * * *